US007878957B1

(12) United States Patent
Chen

(10) Patent No.: US 7,878,957 B1
(45) Date of Patent: Feb. 1, 2011

(54) MULTI-FUNCTIONAL EXERCISING MACHINE

(76) Inventor: Yi-Fan Chen, No. 38, Lane 51, Nandou Rd., Shalu Township, Taichung County (TW)

( * ) Notice: Subject to any disclaimer, the term of this patent is extended or adjusted under 35 U.S.C. 154(b) by 0 days.

(21) Appl. No.: 12/787,481

(22) Filed: May 26, 2010

(51) Int. Cl.
*A63B 22/00* (2006.01)
*A63B 71/00* (2006.01)

(52) U.S. Cl. ..... 482/140; 482/131; 482/51; D21/676

(58) Field of Classification Search ..... 482/51, 482/140, 131, 142, 91–96, 148; D21/676, D21/662, 686, 674, 690
See application file for complete search history.

(56) References Cited

U.S. PATENT DOCUMENTS 3,589,720 A * 6/1971 Agamian ..... 482/114
4,176,836 A * 12/1979 Coyle ..... 482/96
4,974,832 A * 12/1990 Dalebout ..... 482/72
5,407,409 A * 4/1995 Tang ..... 482/70
D375,767 S * 11/1996 Camfield et al. ..... D21/668
5,575,740 A * 11/1996 Piaget et al. ..... 482/70
5,580,340 A * 12/1996 Yu ..... 482/96
5,722,921 A * 3/1998 Simonson ..... 482/100
D397,745 S * 9/1998 Wu ..... D21/668
5,833,584 A * 11/1998 Piaget et al. ..... 482/70
D425,585 S * 5/2000 Wu ..... D21/676
6,093,135 A * 7/2000 Huang ..... 482/72
6,196,954 B1 * 3/2001 Chen ..... 482/131
6,224,519 B1 * 5/2001 Doolittle ..... 482/98
6,540,650 B1 * 4/2003 Krull ..... 482/107
6,565,495 B2 * 5/2003 Slattery ..... 482/142
7,232,404 B2 * 6/2007 Nelson ..... 482/140
7,252,627 B2 * 8/2007 Carter ..... 482/98
7,413,532 B1 * 8/2008 Monsrud et al. ..... 482/99
7,455,633 B2 * 11/2008 Brown et al. ..... 482/142
D584,367 S * 1/2009 Augustine et al. ..... D21/662
7,611,445 B2 * 11/2009 Brown et al. ..... 482/51
2003/0045406 A1 * 3/2003 Stone ..... 482/100
2008/0070765 A1 * 3/2008 Brown et al. ..... 482/140
2008/0070766 A1 * 3/2008 Brown et al. ..... 482/140
2009/0018000 A1 * 1/2009 Brown et al. ..... 482/140

* cited by examiner

*Primary Examiner*—Steve R Crow
(74) *Attorney, Agent, or Firm*—Rabin & Berdo, P.C.

(57) ABSTRACT

A multi-functional exercising machine has a supporting device, a rotating device and a handle device. The supporting device has a base and a pivotal mount. The pivotal mount is formed on the base and has a positioning panel. The rotating device is connected to the supporting device and has a mounting frame, two guiding bars, a limiting rod and a sliding mount. The mounting frame is connected to the pivotal mount and has a pivotal shaft, a connecting panel and a positioning post. The guiding bars are connected to the mounting frame. The sliding mount is mounted on the guiding bars and has a sliding frame and a hassock. The sliding frame is mounted on the guiding bars and has two rollers, two limiting arms and a connecting pin. The hassock is mounted on the sliding frame. The handle device is connected to the supporting device.

8 Claims, 10 Drawing Sheets

MULTI-FUNCTIONAL EXERCISING MACHINE

BACKGROUND OF THE INVENTION

1. Field of the Invention

The present invention relates to an exercising machine, and more particularly to a multi-functional exercising machine that can be used in various manners for whole body exercise.

2. Description of Related Art

Nowadays, urbanites have a limited space for exercise and may use an exercising machine to train their body. Multiple kinds of conventional exercising machines have been marketed, such as exercise bikes, treadmills, rowing machines and surfing machines. The conventional exercising machines are used to simulate exercise during respective sports.

Although the conventional exercising machines can provide an exercising effect, each conventional exercising machine only has a single function so use of the conventional exercised machines is usually a single movement and is unexciting or boring. In addition, when using the conventional exercising machines, only certain muscle groups are trained.

The invention provides a multi-functional exercising machine that mitigates or obviates the aforementioned problems.

SUMMARY OF THE INVENTION

The main objective of the present invention is to provide a multi-functional exercising machine that can be used variously and can train the whole body of a user.

The multi-functional exercising machine in accordance with the present invention has a supporting device, a rotating device and a handle device. The supporting device has a base and a pivotal mount. The pivotal mount is formed on and protrudes from the middle of the base and has a positioning panel. The rotating device is rotatably connected to the supporting device and has a mounting frame, two guiding bars, a limiting rod and a sliding mount. The mounting frame is pivotally connected to the pivotal mount and has a pivotal shaft, a connecting panel and a positioning post. The guiding bars are connected to the mounting frame and are parallel with each other. The sliding mount is movably mounted on the guiding bars and has a sliding frame and a hassock. The sliding frame is movably mount on the guiding bars and has two rollers, two limiting arms and a connecting pin. The hassock is securely mounted on the sliding frame. The handle device is securely connected to the supporting device and has an extending frame and a handle frame. The extending frame is connected to the base. The handle frame is connected to the extending frame.

Other objectives, advantages and novel features of the invention will become more apparent from the following detailed description when taken in conjunction with the accompanying drawings.

BRIEF DESCRIPTION OF THE DRAWINGS

FIG. 2 is another perspective view of the multi-functional exercising machine in

FIG. 1;

DETAILED DESCRIPTION OF THE PREFERRED EMBODIMENT

With reference to FIGS. 1 to 5, a multi-functional exercising machine in accordance with the present invention comprises a supporting device 10, a rotating device 20 and a handle device 30.

Figure 7:
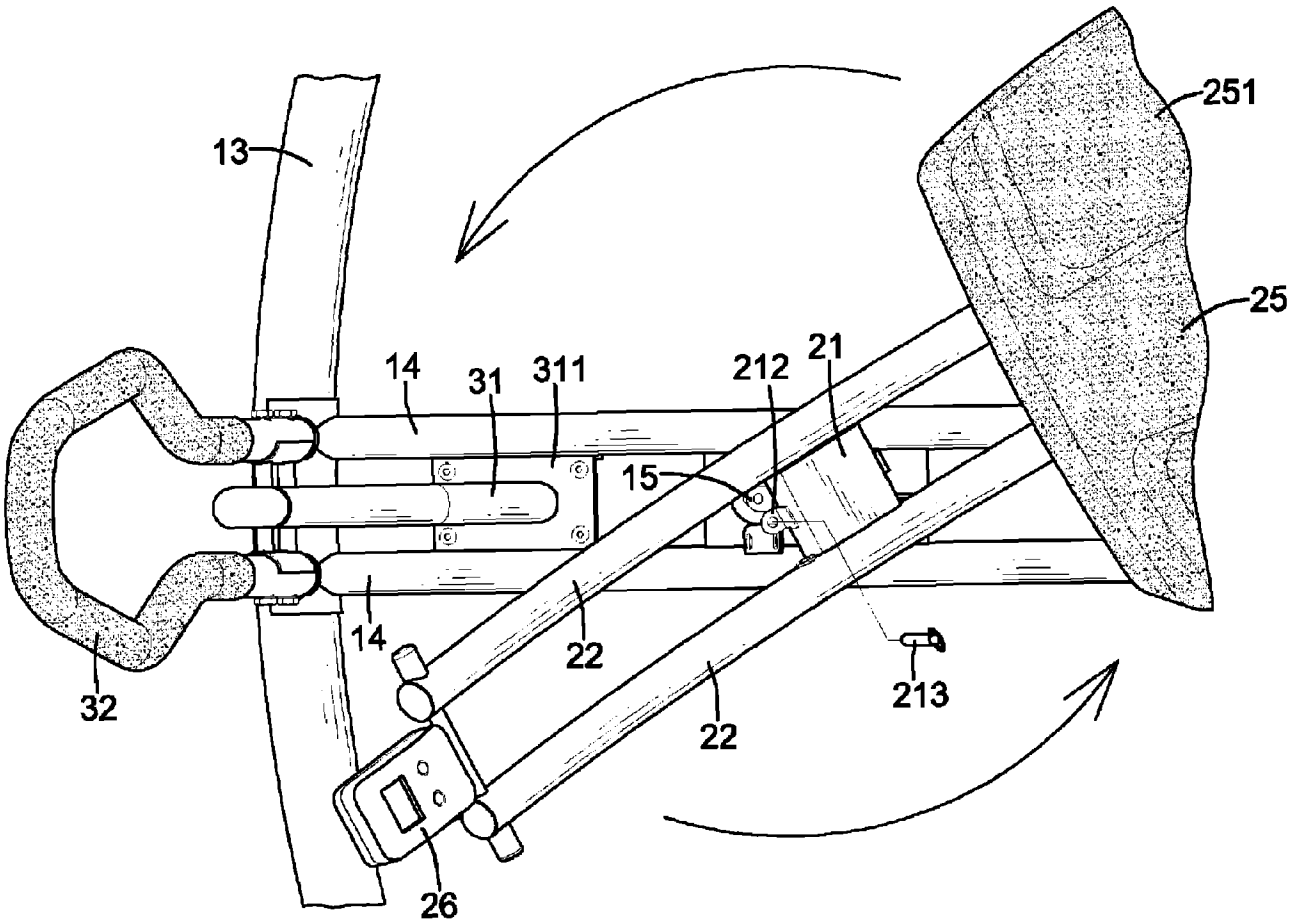
FIG. 7 is an exploded operational top view of the multi-functional exercising machine in FIG. 6 in the rotating operation mode.

The supporting device 10 has a base 11 and a pivotal mount 12. The base 11 may be I-shaped and has two transverse legs 13 and two longitudinal legs 14. Each transverse leg 13 has a bottom, two ends and two skid-proof pads 131. The skid-proof pads 131 are mounted on bottom of the transverse leg 13 respectively near the ends. The longitudinal legs 14 are connected to the transverse legs 13 to form the I-shaped base 11 and are parallel with each other, and each longitudinal leg 14 has a middle and a front end. With further reference to FIG. 7, the pivotal mount 12 is connected between the middles of the longitudinal legs 14 of the base 11 and has a front side, a top end, a bottom end and a positioning panel 15. The positioning panel 15 is formed on and protrudes from the front side of the pivotal mount 12 near the top end.

The rotating device 20 is rotatably connected to the supporting device 10 and has a mounting frame 21, two guiding bars 22, a limiting rod 221, a sliding mount 23 and a swinging counter 26. The mounting frame 21 is pivotally connected to the pivotal mount 12 and has a bottom, a top, a front side, two sidewalls, a pivotal shaft 211, a connecting panel 212 and a positioning post 213. The pivotal shaft 211 is mounted on and protrudes from the bottom of the mounting frame 21 and is rotatably mounted in the pivotal mount 12. The connecting panel 212 is mounted on and protrudes from the front side of the mounting frame 21 near the top end and aligns with the positioning panel 15 of the pivotal mount 12. The positioning post 213 is detachably connected to the positioning panel 15 and the connecting panel 213 to hold the mounting frame 21 pivotally with the pivotal mount 12.

Figure 9:
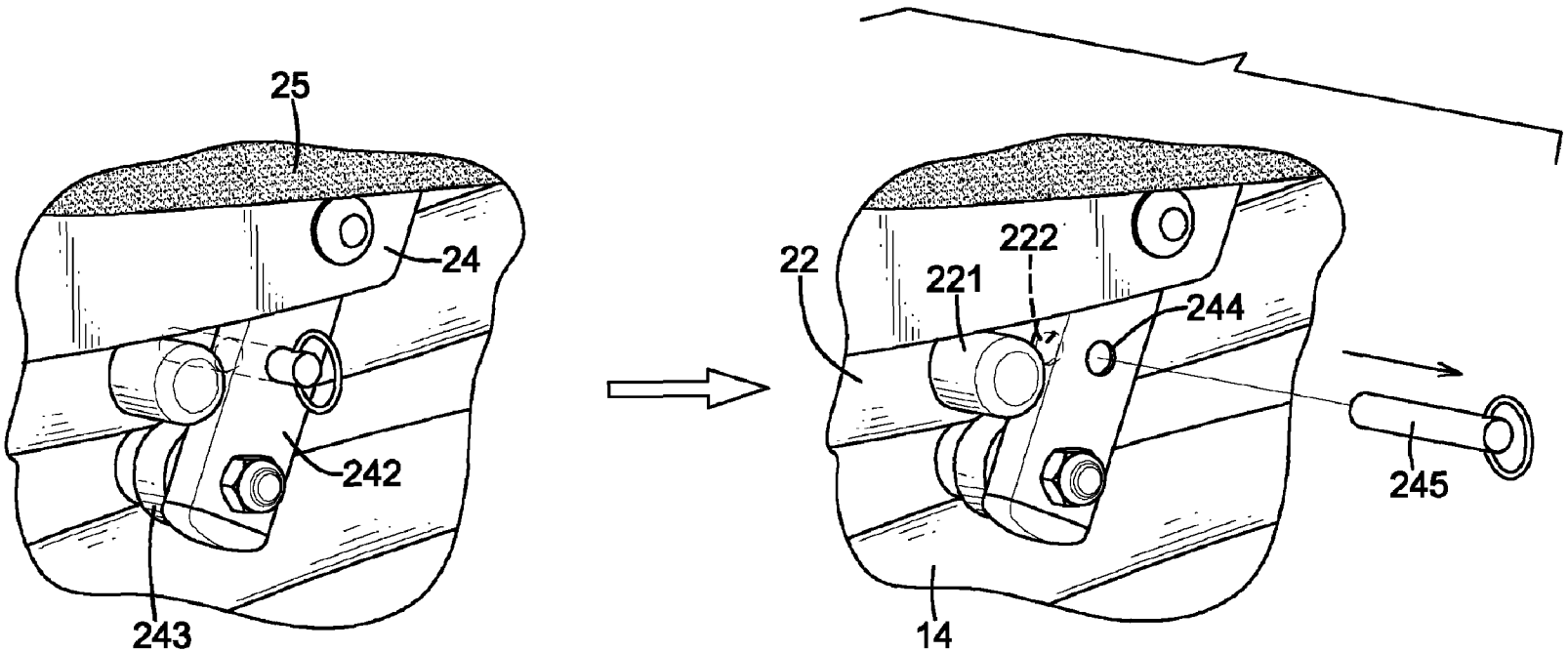
FIG. 9 are operational side views of the multi-functional exercising machine in FIG. 1.

The guiding bars 22 are curved, are respectively connected to the sidewalls of the mounting frame 21 and are parallel with each other, and each guiding bar 22 has a rear end, a middle, a front end and an external surface. The middles of the guiding bars 22 are connected to the sidewalls of the mounting frame 21. The limiting rod 221 is transversally mounted on the guiding bars 22 near the rear ends and has two free ends respectively extending out of the external surfaces of the guiding bars 22. With reference to FIG. 9, one of the guiding bars 22 has a holding hole 222 formed through the external surface of the guiding bar 22 near the limiting rod 221.

The sliding mount 23 is movably mounted on the guiding bars 22 and has a sliding frame 24 and a hassock 25. The sliding frame 24 is movably mounted on the guiding bars 22 and has a bottom, a top, a front side, two rollers 241, two limiting arms 242 and a connecting pin 245. The rollers 241 are transversally and rotatably mounted on the bottom of the sliding frame 24 at an interval and abut with the external surfaces of the guiding bars 22. The limiting arms 242 are mounted on and protrude from the bottom of the sliding frame 24 near the front side, abut with the free ends of the limiting rod 221 when the sliding mount 24 moves to the rear ends of the guiding bars 22 and each limiting arm 242 has a free end and a rotating wheel 243. The free ends of the limiting arms 242 are extended downward beside the guiding bars 22. The rotating wheels 243 are respectively and rotatably connected to the free ends of the limiting arms 242 and abut with the external surfaces of the guiding bars 22 below the rollers 241. Thus, the sliding frame 24 can be movably mounted on the guiding bars 22 by the rollers 241 and the rotating wheels 243. With further reference to FIG. 9, one of the limiting arms 242 has a through hole 244 aligning with the holding hole 222 of the guiding bar 22. The connecting pin 245 is detachably mounted in the holding hole 222 and the through hole 244. Thus, the sliding frame 24 can be securely held on the guiding bars 22 by the connecting pin 245.

The hassock 25 is securely mounted on the top of the sliding frame 24 and has a top and two mounting recesses 251. The mounting recesses 251 are formed in the top of the hassock 25 at an interval to aid positioning of the legs of the user. The swinging counter 26 is mounted on the front ends of the guiding bars 22 and has an emitter mounted on the bottom end of the pivotal mount 12 to emit a signal to the swinging counter 26 to count the swinging times of the rotating device 20 relative to the supporting device 10

The handle device 30 is securely connected to the supporting device 10 and has an extending frame 31 and a handle frame 32. The extending frame 31 is connected to the base 11, extends upward from the base 11 in front of the rotating device 20 and has a bottom end, a top end and a fixed mount 311. The fixed mount 311 is mounted on the bottom end of the extending frame 31 and is mounted between the guiding bars 22 near the front ends. The handle frame 32 may be U-shaped and has two free ends connected to the top end of the extending frame 31.

Figure 1:
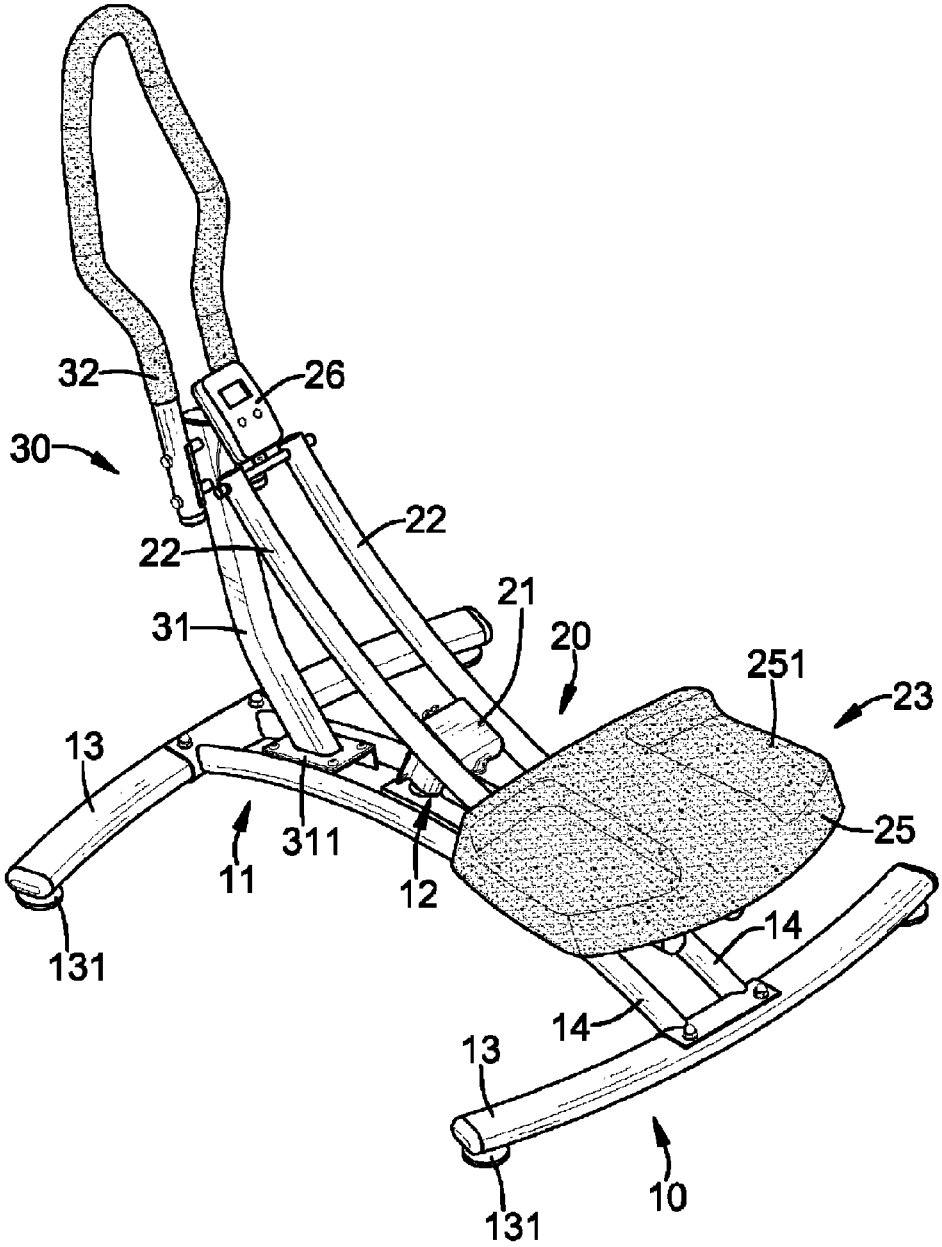
FIG. 1 is a perspective view of a multi-functional exercising machine in accordance with the present invention.
Figure 2:
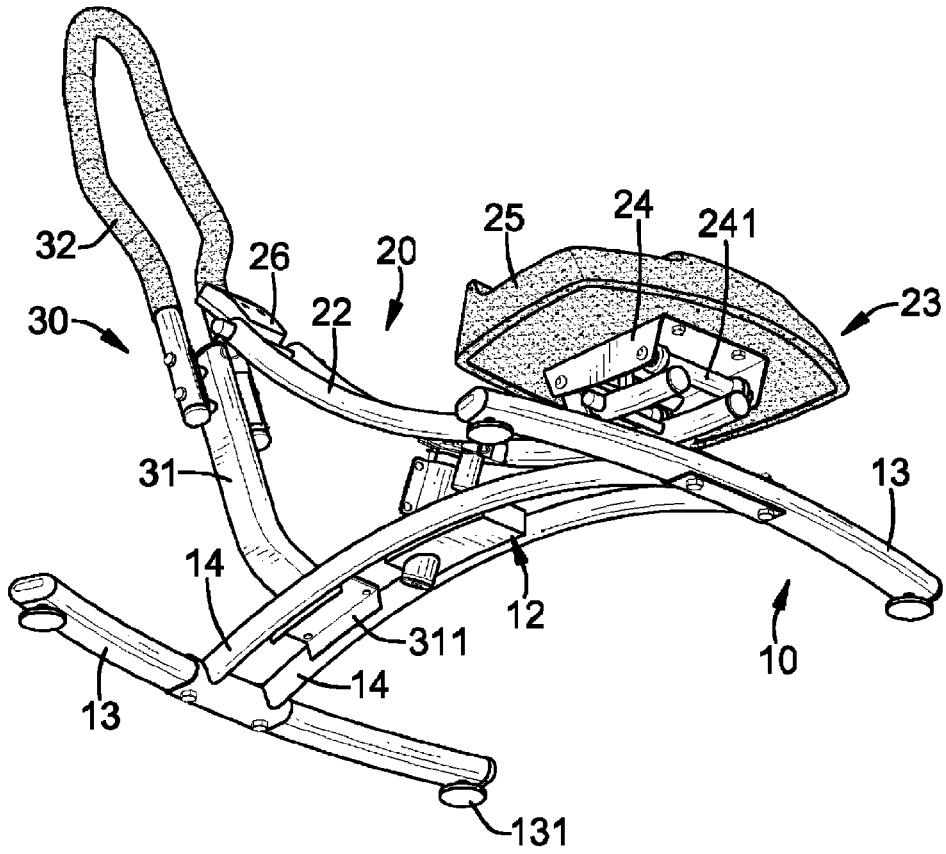
Figure 3:
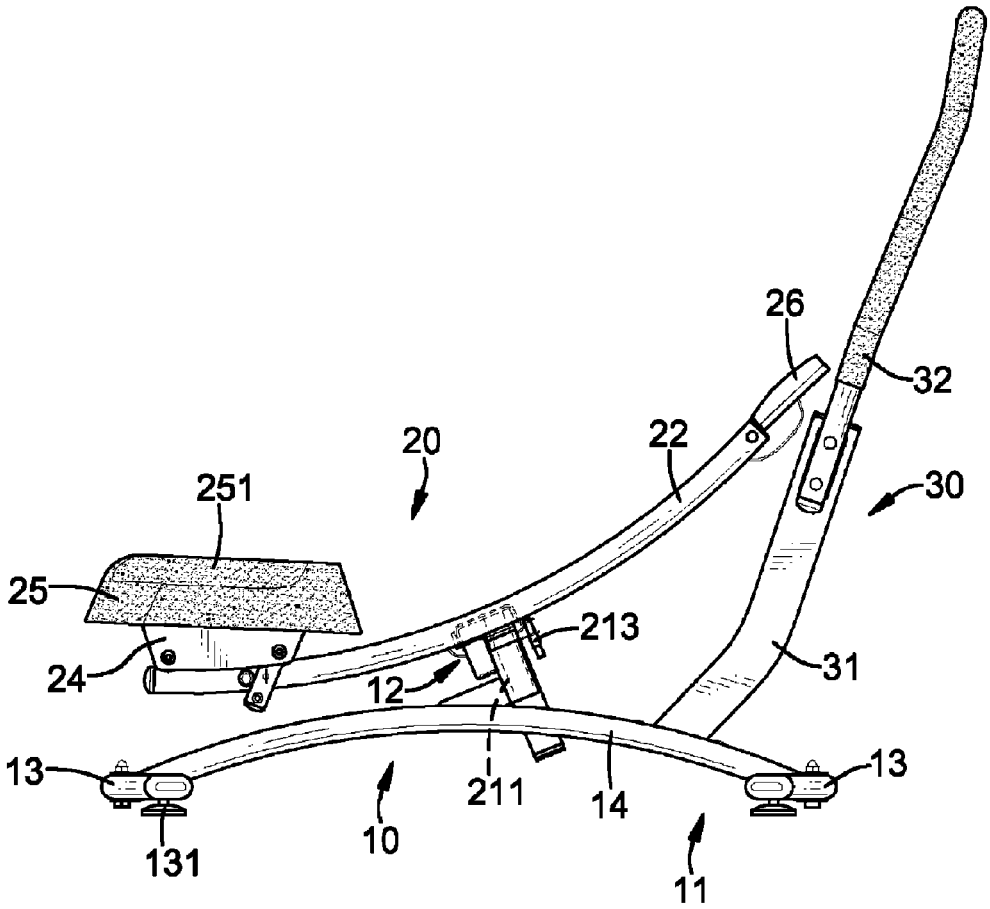
FIG. 3 is a side view of the multi-functional exercising machine in FIG. 1.
Figure 4:
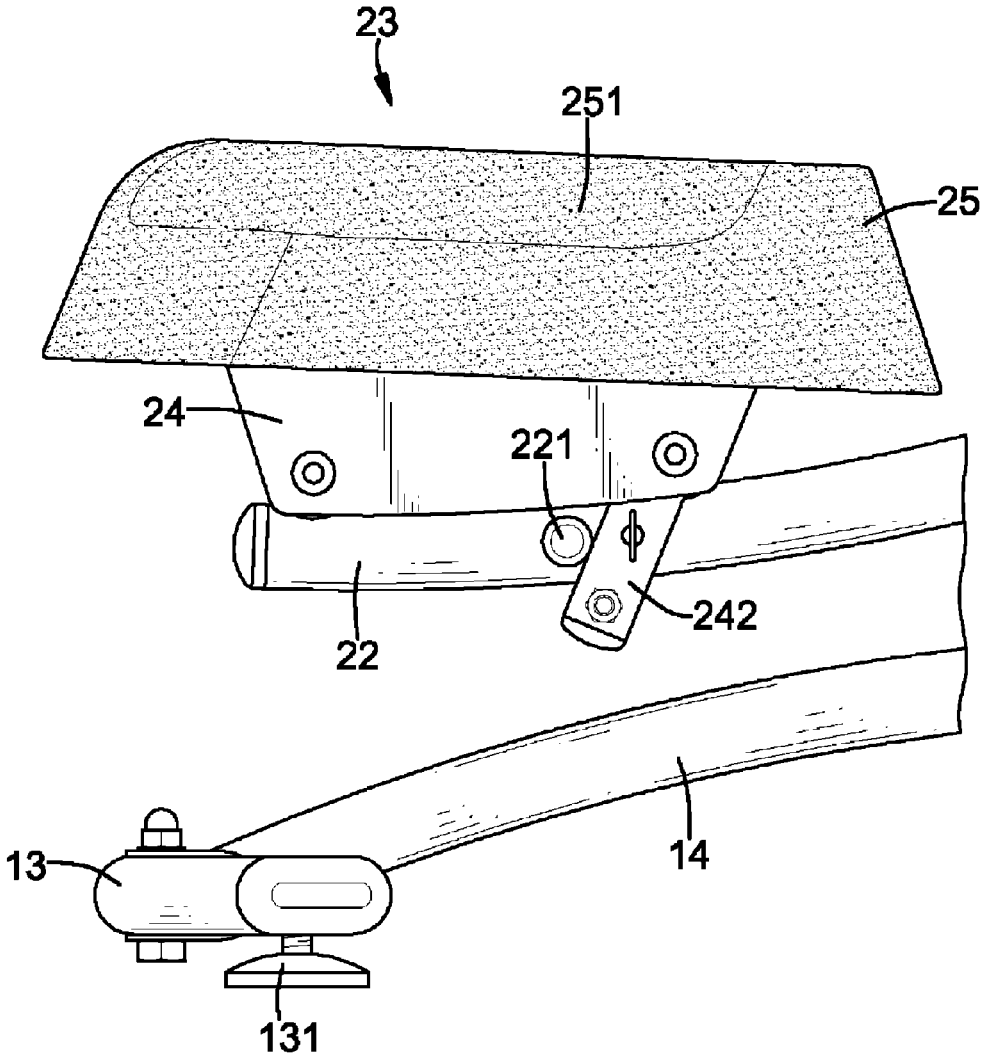
FIG. 4 is an enlarged side view of the multi-functional exercising machine in FIG. 3.
Figure 5:
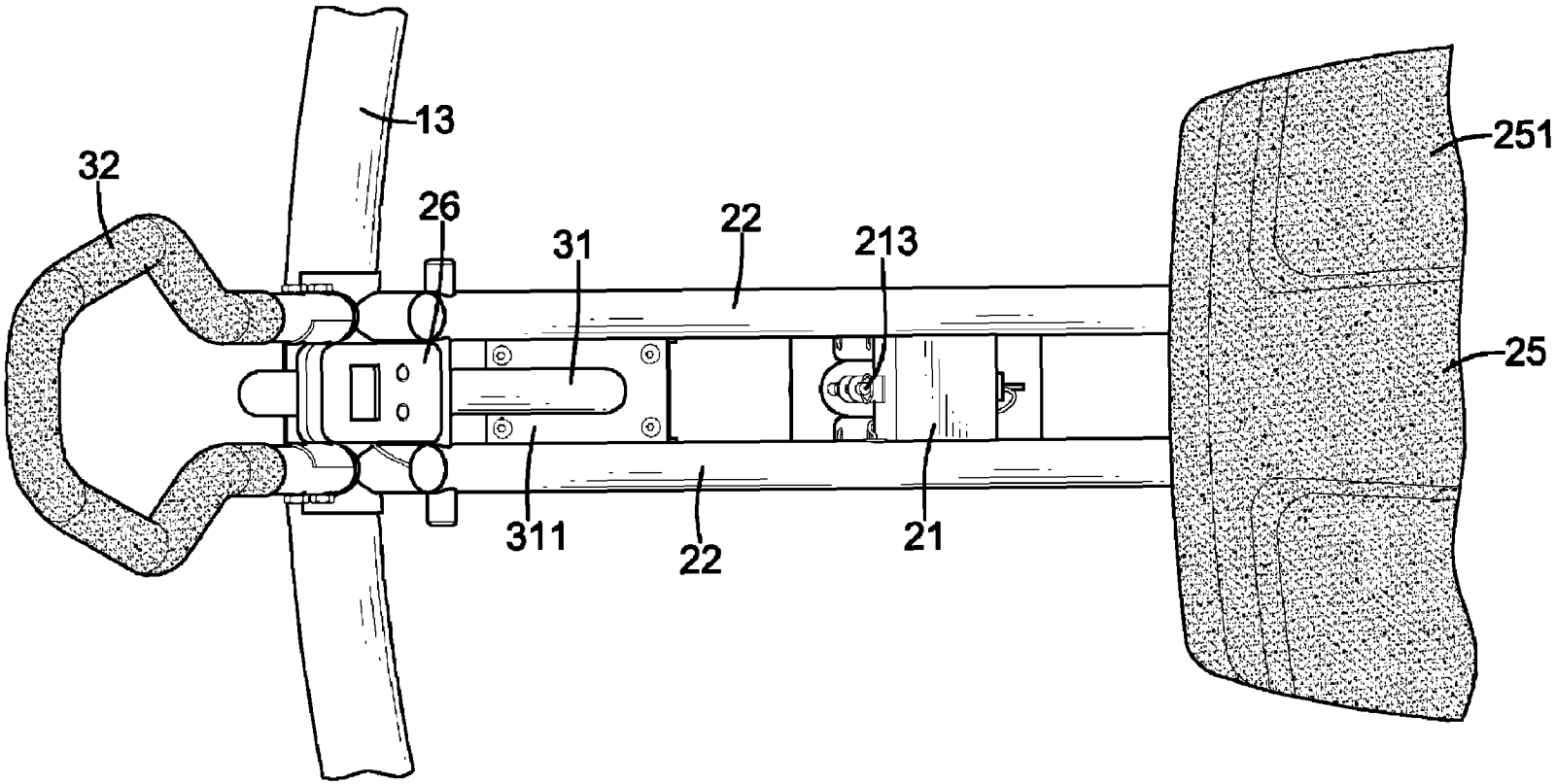
FIG. 5 is an enlarged top view of the multi-functional exercising machine in FIG. 1.
Figure 6:
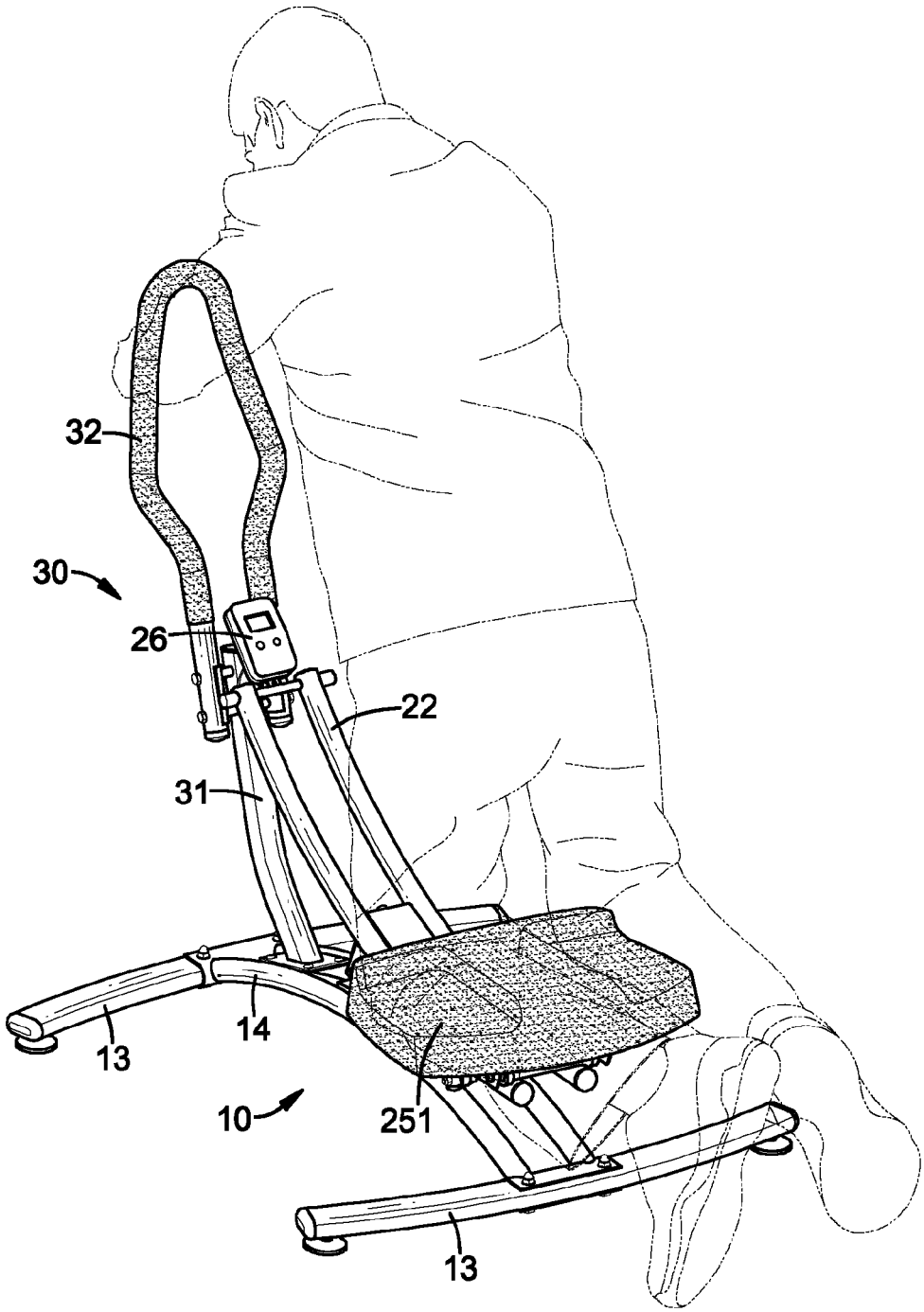
FIG. 6 is an operational perspective view of the multi-functional exercising machine in FIG. 1 in a rotating operation mode.
Figure 8:
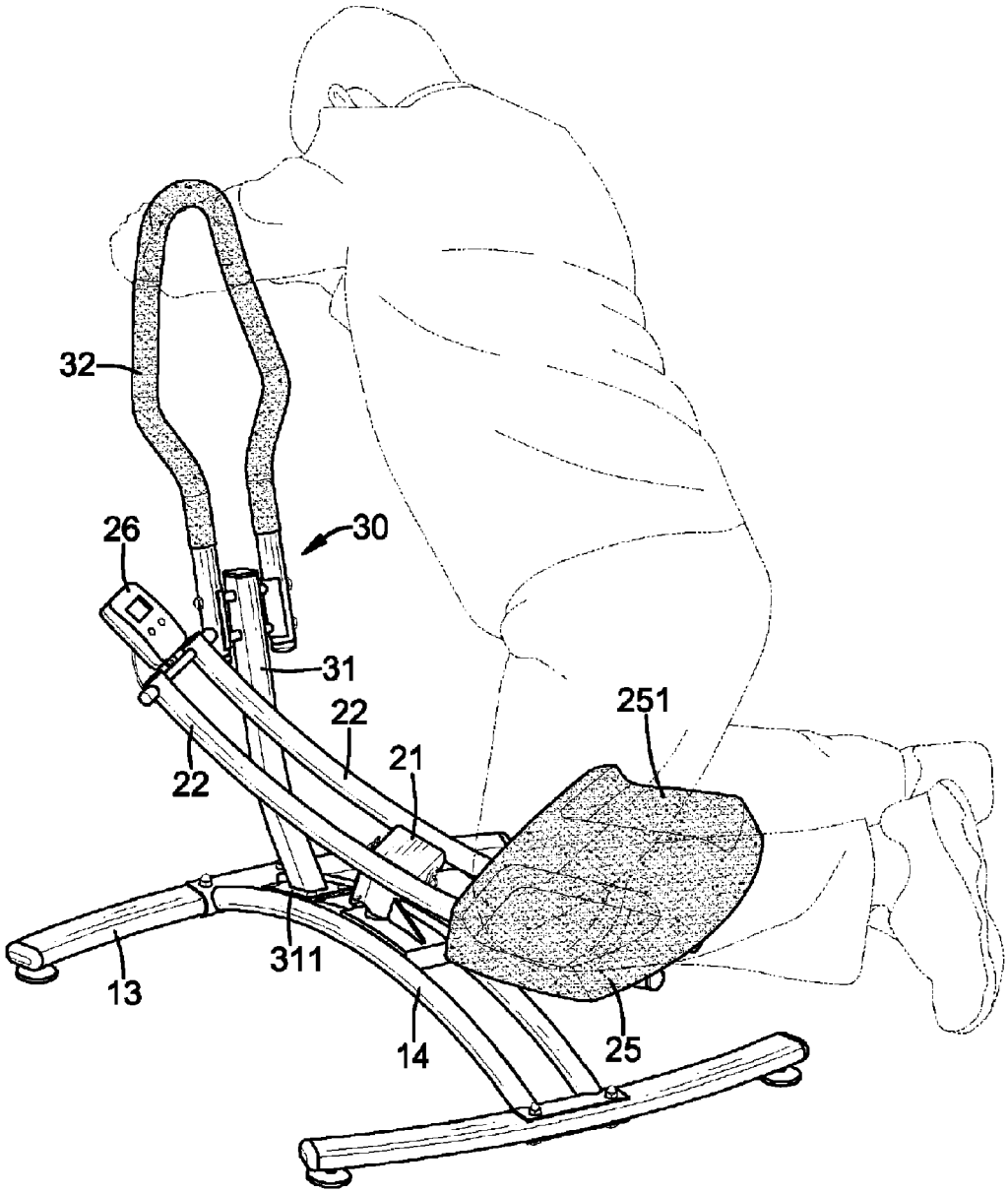
FIG. 8 is another operational perspective view of the multi-functional exercising machine in FIG. 6 in the rotating operation mode.

With reference to FIG. 6, when using the multi-functional exercising machine in accordance with the present invention, the legs of a user are positioned in the mounting recesses 251 of the hassock 25 and the hands of the user grip the handle frame 32. When removing the positioning post 213 from the positioning panel 15 and the connecting panel 212, with reference to FIG. 7, the pivotal shaft 211 of the mounting frame 21 can be rotated relative to the pivotal mount 12. Then, the rotating device 20 can be rotated relative to the supporting device 10 and the handle device 30. With reference to FIG. 8, the user can twist his waist and swing legs while the rotating device 20 is rotating relative to the supporting device 10 and the handle device 30.

Figure 10:
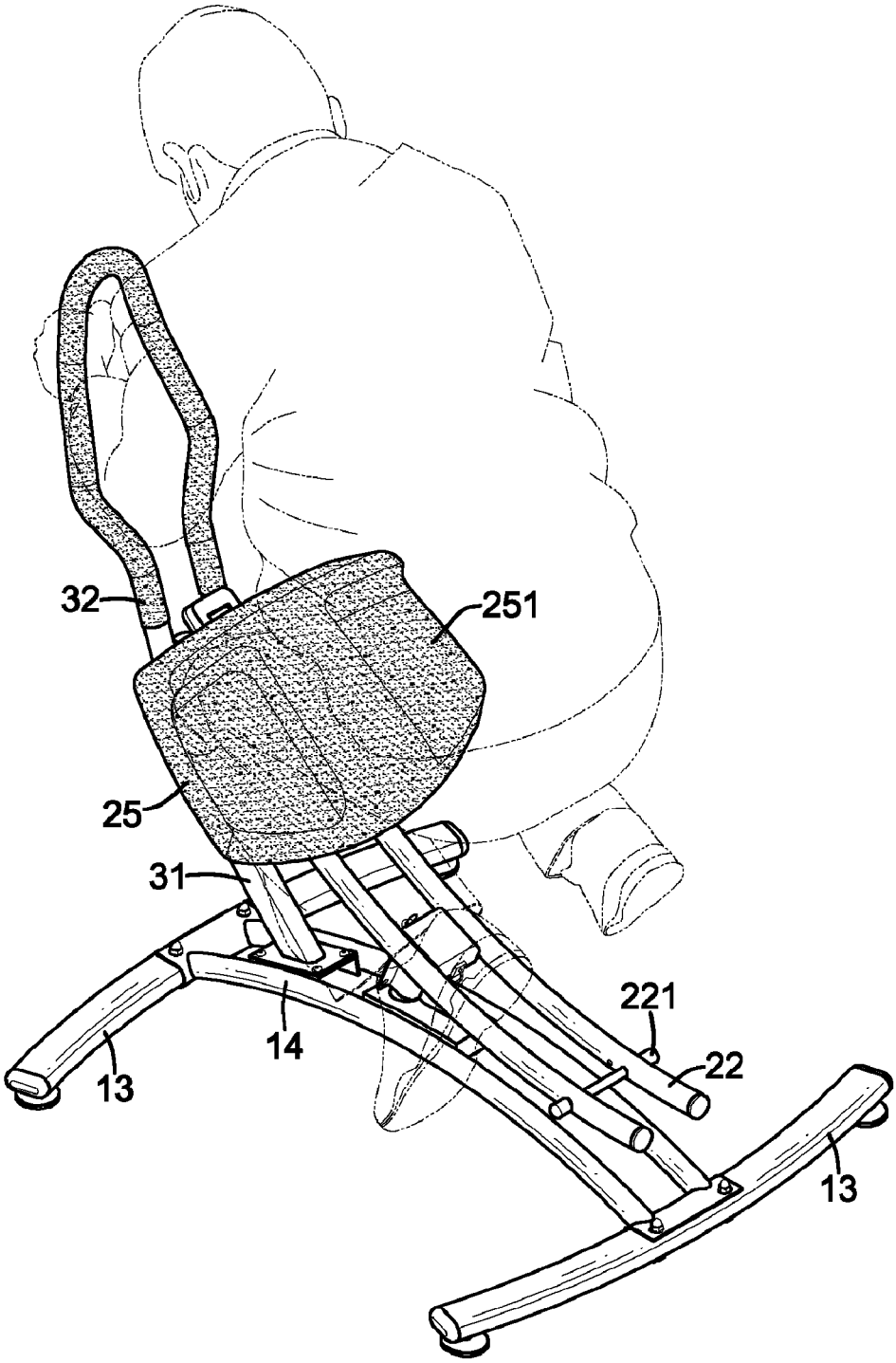
FIG. 10 is an operational perspective view of the multi-functional exercising machine in FIG. 1 in a sliding operation mode.

With reference to FIG. 9, when removing the connecting pin 245 from the holding hole 222 of the guiding bar 22 and the through hole 244 of the limiting arm 242, the sliding frame 24 can be moved along the guiding bars 22 relative to the base 11. The user can move and compress his waist and swing legs while the hassock 25 is moving along the guiding bars 22 relative to the base 11 as shown in FIG. 10. Furthermore, when the positioning post 213 and the connecting pin 245 are respectively pulled out of the panels 15, 212 and the holes 222, 244 at the same time, the user can twist, move and compress his waist and swing legs at the same time.

The multi-functional exercising machine as described has the following advantages:

1. The multi-functional exercising machine has a rotating device 30 that can be rotated and moved relative to the supporting device 10, so users can exercise and train whole bodies at the same time and the exercising machine is versatile in use.

2. The operation of the exercised machine is versatile and various, and user will feel excited and interested to use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A multi-functional exercising machine comprising a supporting device having a base being I-shaped and having two transverse legs; and two longitudinal legs connected to the transverse legs to form the I-shaped base, being parallel with each other and each longitudinal leg having a middle and a front end;

a pivotal mount connected between the middles of the longitudinal legs of the base and having a front side;

a top end;

a bottom end; and a positioning panel formed on and protruding from the front side of the pivotal mount near the top end;

a rotating device pivotally connected to the supporting device and having a mounting frame pivotally connected to the pivotal mount and having a bottom;

a top;

a front side;

two sidewalls;

a pivotal shaft mounted on and protruding from the bottom of the mounting frame and rotatably mounted in the pivotal mount;

a connecting panel mounted on and protruding from the front side of the mounting frame near the top end and aligning with the positioning panel of the pivotal mount; and a positioning post detachably connected to the positioning panel and the connecting panel to hold the mounting frame pivotally with the pivotal mount;

two guiding bars being curved, respectively connected to the sidewalls of the mounting frame and being parallel with each other and each guiding bar having a rear end;

a middle connected to one of the sidewalls of the mounting frame;

a front end; and an external surface;

wherein one of the guiding bars has a holding hole formed through the external surface of the guiding bar near the limiting rod;

a limiting rod transversally mounted on the guiding bars near the rear ends and having two free ends respectively extended out of the external surfaces of the guiding bars; and a sliding mount movably mounted on the guiding bars and having a sliding frame movably mounted on the guiding bars and having a bottom;

a top;

a front side;

two rollers transversally and rotatably mounted on the bottom of the sliding frame at an interval and abutting with the external surfaces of the guiding bars;

two limiting arms mounted on and protruding from the bottom of the sliding frame at an interval near the front side of the sliding frame and abutting with the free ends of the limiting rod when the sliding mount moves to the rear ends of the guiding bars and each limiting arm having a free end extending downward beside one of the guiding bars; and a rotating wheel rotatably connected to the free end of the limiting arm below the rollers and abutting with the external surfaces of a corresponding guiding bar;

wherein one of the limiting arm having a through hole aligning with the holding hole of the guiding bar; and a connecting pin detachably mounted in the holding hole and the through hole to hold the sliding frame securely on the guiding bars; and a hassock securely mounted on the top of the sliding frame; and a handle device securely connected to the supporting device and having an extending frame connected to the base, extending upward from the base ahead the rotating device and having a top end;

a bottom end; and a fixed mount formed on the bottom end of the extending frame and mounted between the guiding bars near the front ends of the guiding bars; and a handle frame connected to the top end of the extending frame.

2. The multi-functional exercising machine as claimed in claim 1, wherein each transverse leg has a bottom;

two ends; and two skid-proof pads mounted on bottom of the transverse leg respectively near the ends of the transverse leg.

3. The multi-functional exercising machine as claimed in claim 2, wherein the hassock has a top; and two mounting recesses formed in the top of the hassock at an interval.

4. The multi-functional exercising machine as claimed in claim 3, wherein the rotating device has a swinging counter mounted on the front ends of the guiding bars.

5. The multi-functional exercising machine as claimed in claim 4, wherein the handle frame is U-shaped and has two free ends connected to the top end of the extending frame.

6. The multi-functional exercising machine as claimed in claim 1, wherein the hassock has a top; and two mounting recesses formed in the top of the hassock at an interval.

7. The multi-functional exercising machine as claimed in claim 1, wherein the rotating device has a swinging counter mounted on the front ends of the guiding bars.

8. The multi-functional exercising machine as claimed in claim 1, wherein the handle frame is U-shaped and has two free ends connected to the top end of the extending frame.

* * * * *